US008296976B2

(12) United States Patent
Murphy et al.

(10) Patent No.: US 8,296,976 B2
(45) Date of Patent: Oct. 30, 2012

(54) METHOD FOR COMMUNICATING PERFORMANCE ATTRIBUTES

(75) Inventors: Harrison Murphy, Great Falls, VA (US); Juraj Michal Daniel Slavik, II, McLean, VA (US)

(73) Assignee: Kickball Concepts, LLC, Great Falls, VA (US)

( * ) Notice: Subject to any disclaimer, the term of this patent is extended or adjusted under 35 U.S.C. 154(b) by 0 days.

(21) Appl. No.: 11/811,246

(22) Filed: Jun. 8, 2007

(65) Prior Publication Data

US 2008/0301983 A1 Dec. 11, 2008

Related U.S. Application Data

(60) Provisional application No. 60/812,514, filed on Jun. 9, 2006.

(51) Int. Cl.
*A47C 27/15* (2006.01)

(52) U.S. Cl. ..... 40/320; 5/690; 5/691; 5/728

(58) Field of Classification Search ..... 5/690, 482, 5/636; 40/320, 727
See application file for complete search history.

(56) References Cited

U.S. PATENT DOCUMENTS 3,148,389 A * 9/1964 Lustig ..... 5/645
4,876,755 A * 10/1989 Parrish ..... 297/284.3
4,959,880 A * 10/1990 Tesch ..... 5/636
5,107,558 A 4/1992 Luck
5,136,741 A 8/1992 Balonick et al.
5,513,402 A * 5/1996 Schwartz ..... 5/691
5,701,623 A 12/1997 May
5,745,941 A 5/1998 Miller, Sr.
5,815,865 A 10/1998 Washburn et al.
5,819,349 A 10/1998 Schwartz
5,850,648 A 12/1998 Morson
5,953,777 A * 9/1999 Buck ..... 5/636
5,953,779 A 9/1999 Schwartz
6,256,821 B1 * 7/2001 Boyd ..... 5/722
6,481,033 B2 11/2002 Fogel
6,804,848 B1 10/2004 Rose
6,854,143 B2 2/2005 Sharples
6,874,185 B1 4/2005 Phillips et al.
6,918,146 B2 * 7/2005 England ..... 5/653
7,386,903 B2 * 6/2008 Hochschild ..... 5/740
2004/0163180 A1 * 8/2004 Bryant et al. ..... 5/690
2004/0237206 A1 * 12/2004 Webster et al. ..... 5/727
2006/0048304 A1 3/2006 Boyd

* cited by examiner

*Primary Examiner* — Casandra Davis
(74) *Attorney, Agent, or Firm* — Triangle Patents, P.L.L.C.

(57) ABSTRACT

A method of using color or color schemes to simplify the communication to consumers of complex information regarding the combinations and interactions of technically oriented performance attributes that describe the degree of comfort as found in mattresses, mattress foundations, upholstered furniture articles and other articles filled with cushioning materials. Additionally the selected method of using color as a communication tool may be of further benefit in the interaction with consumers by developing strong emotional ties to the consumers purchase decision.

27 Claims, 5 Drawing Sheets

Figure 4 - One Dimensional Matrix
TINT RANGE FOR COLOR (HUE) BLUE AS REPRESENTATION OF DECREASING DENSITY OF FOAM
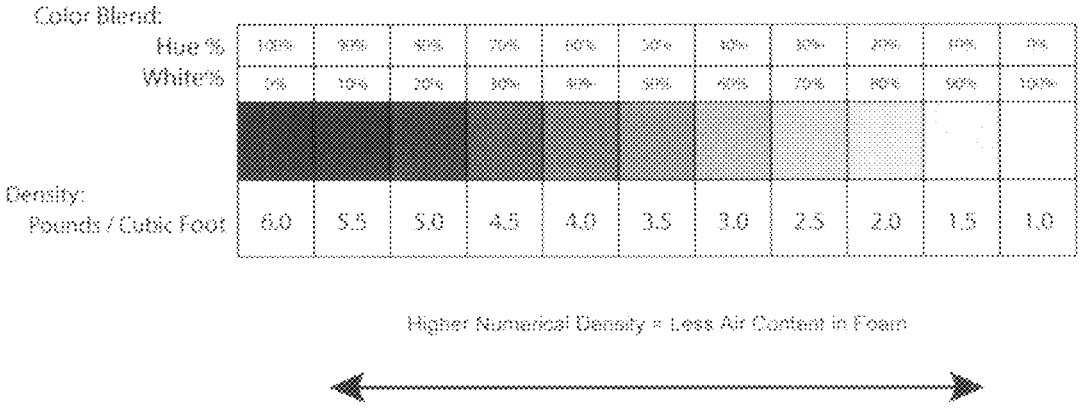
Figure 5 - Two Dimensional Matrix
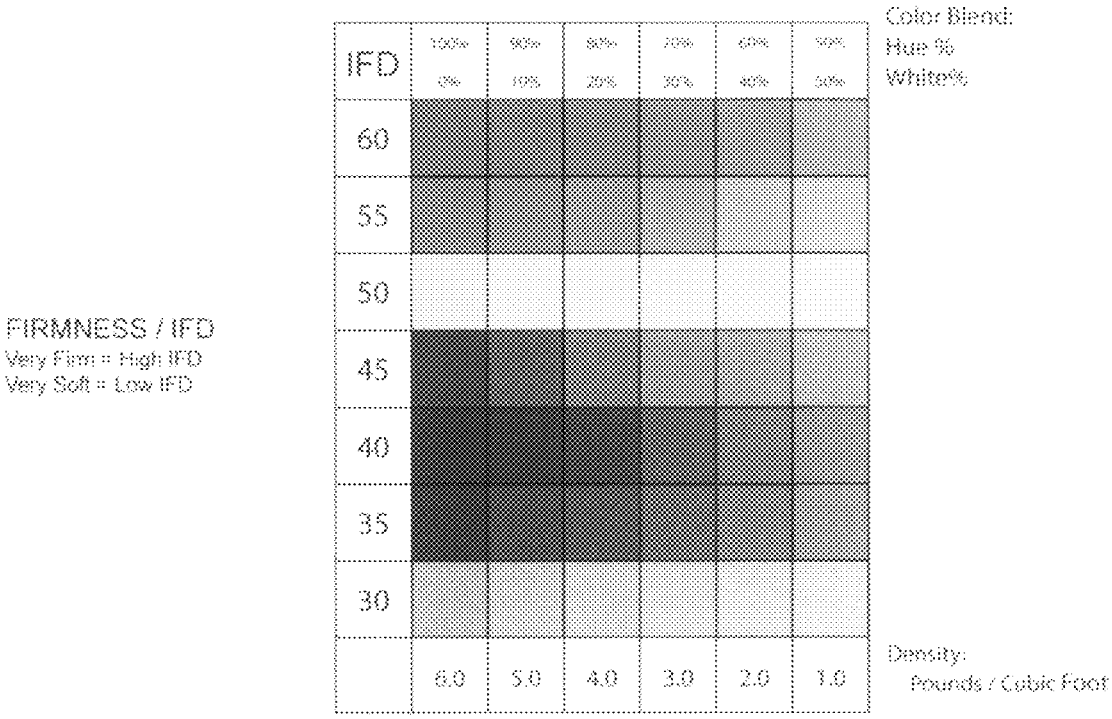

Figure 6 - Three Dimensional Matrix
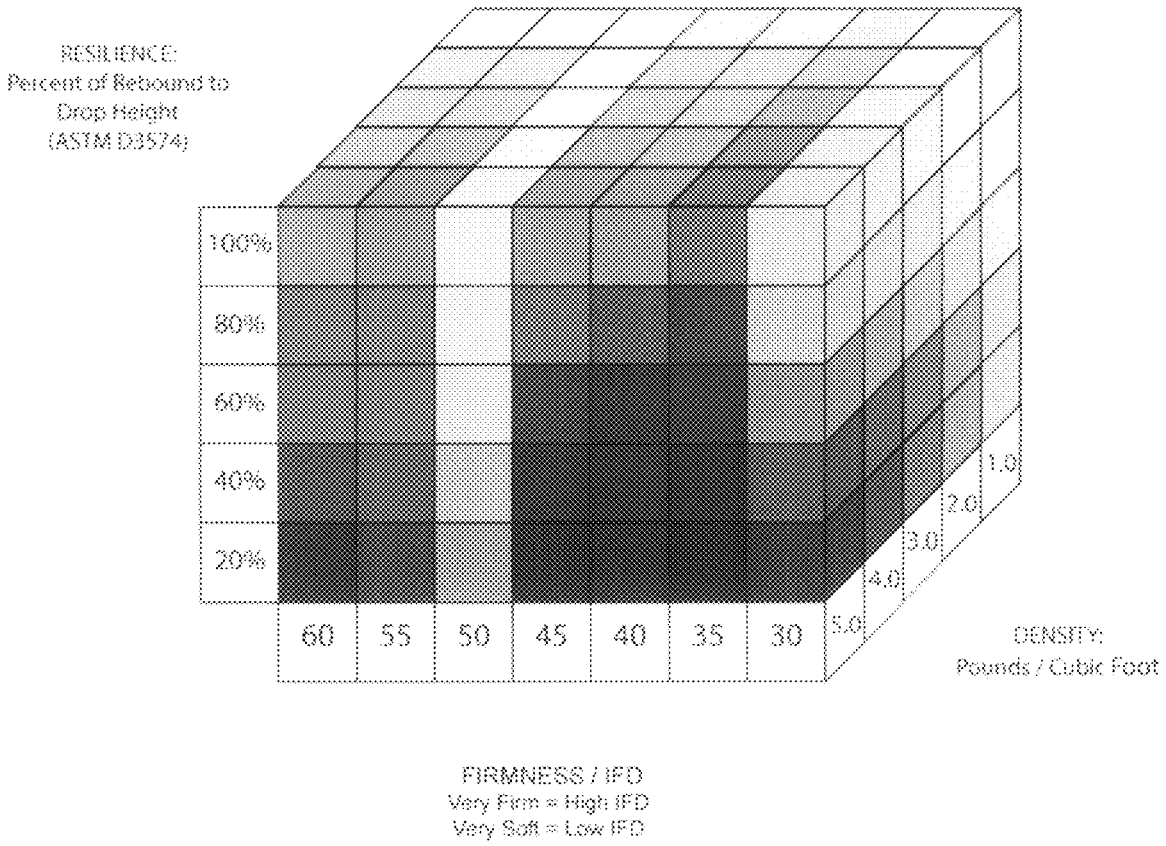
An example of a method for using variations in color selection to communicate differential performance attributes in the flexible polyurethane foam used in a home furnishing article.

METHOD FOR COMMUNICATING PERFORMANCE ATTRIBUTES

CROSS-REFERENCE TO RELATED APPLICATIONS

This non-provisional utility patent application claims the benefit of provisional application Ser. No. 60/812,514, filed Jun. 9, 2006, which is incorporated herein by reference in its entirety.

FIELD OF THE INVENTION

The invention relates to a method of using color and labeling schemes to simplify the communication of complex information regarding the combinations and interactions of technically oriented performance attributes found in mattresses, mattress foundations, upholstered furniture articles and other articles filled with resilient cushioning materials to consumers. These performance attributes are predominantly the parameters that determine the concept of comfort and are used to convey differentiated degrees of comfort when marketing to consumers. Additionally the selected method of using color as a communication tool may be of further benefit in the interaction with consumers by developing or evoking strong, positive emotional reactions to the consumer's purchase decision.

BACKGROUND OF THE INVENTION

According to the International Sleep Products Association (ISPA) the domestic US mattress industry shipped mattresses and foundation units in 2004 totaling 41 million pieces or roughly 20 million sets of bedding with a retail value in excess of $10 billion.

According to the American Home Furnishings Association (AHFA) the domestic US retail sales of furniture in 2005 totaled approximately $37.6 billion.

Much of the history of the structural design approach to making and assembling mattresses, mattress foundations, upholstered furniture articles and other articles filled with resilient cushioning materials has seen the introduction of innovation in terms of small, incremental changes—for instance changes in the use of new filling materials or new cover fabrics.

There has, however, recently been dramatic change to the structural design approaches found in mattresses. In the last several years the introduction of user-adjustable air-bladder based sleep systems, development of new "space-age" memory foams.

Numerous filling or cushioning materials are used to construct mattresses, mattress foundations, upholstered furniture articles and other articles filled with cushioning materials. These can be made from foam, fiber, hair block, colloids or other similar resilient material or the cushioning elements may also be made from use of bladders or chambers filled with gases or liquids, such as air or water or the cushioning material may be a spring unit Manufacturers of flexible polyurethane foam, textile fibers and other resilient filling materials employ a wide variety of technical measurements to communicate the performance attributes engineered into particular foams. Such technical measurements include indentation force deflection (IFD), indentation load deflection (ILD), tensile strength, tear strength, density pounds per cubic foot (PCF), flex fatigue, denier, cut length, and basis weight.

Materials may be further differentiated by their composition. In the case of flexible polyurethane foams, for instance, there are visco-elastic foams, latex foams, memory foams, conventional foams, filled conventional foams, high resiliency (HR) foams, modified HR foams, combustion modified foams, melamine modified foams—all of which can be made at differing densities and hardness, making the possible total number of combinations potentially limitless.

The complexity of the technical measures that are intended to communicate important performance characteristics to users are even difficult for those skilled in the art to comprehend. These technical measures are predominantly the science that underlies the concept of comfort that serves as the foundation of most marketing efforts for such articles.

It is likely that consumers, untrained in such technical specifics will not be able to fully understand the information presented or more critically may be confused by technical complexity and therefore fail to fully appreciate the range of benefits potentially being offered to them.

There exists a need to create a more basic method to communicate this highly technical information to consumers so that the producers of such material can capture the full value of the products that they are creating and also to ensure that consumers establish a more meaningful emotional attachment to the materials in question.

Color is a very powerful tool. It evokes responses on primitive, emotional levels and has been described as a catalyst for feelings. Color has the ability to convey strong sense's of one's self and has even been shown to confer healthful benefits in certain settings. Color choices can stimulate energy or promote calm. Color can also serve to quickly differentiate one item from another.

The psychology of color and color selection has been widely studied and there are numerous associations that have been identified between particular colors and the symbolism that they represent and the impact that varying cultures and/or lifestyles may have on these interpretations. The following table (Table 1) offers one example of the ranges of common connotations that can be inferred from specific color selections and does include some references to the cultural interpretations that may result as well.

TABLE 1

| Color | Common connotations |
|---|---|
| Gray | Elegance, humility, respect, reverence, stability, subtlety, wisdom, anachronism, boredom, decay, decrepitude, dullness, dust, pollution, urban sprawl, strong emotions, balance, neutrality, mourning, formality, March. |
| White | Reverence, purity, snow, peace, innocence, cleanliness, simplicity, security, humility, sterility, winter, coldness, clinicism, surrender, cowardice, fearfulness, unimaginative, air, fire, death (Eastern cultures), hope, Aries, Pisces (star signs), January. |
| Black | Modernity, power, sophistication, formality, elegance, wealth, mystery, style, evil, death (Western cultures), fear, anonymity, anger, sadness, remorse, mourning, unhappiness, mysterious, sex, seriousness, conventionality, rebellion, sorrow, January. |
| Red | Passion, strength, energy, fire, love, sex, excitement, speed, heat, arrogance, ambition, leadership, masculinity, power, danger, gaudiness, blood, war, anger, revolution, radicalism, socialism, communism, aggression, summer, autumn, stop, Mars (planet), respect, Gemini (star sign), December. Studies show that red can have a physical effect, increasing the rate of respiration and raising blood pressure; red also is said to make people hungry; the red ruby is the traditional 40th wedding anniversary gift; red sky in the morning, shepherd's warning; red sky at night, shepherd's delight. |
| Blue | Seas, skies, peace, unity, harmony, tranquility, calmness, coolness, confidence, conservatism, water, ice, loyalty, dependability, cleanliness, technology, winter, depression, |

TABLE 1-continued

| Color | Common connotations |
|---|---|
| | coldness, idealism, obscenity, tackiness, air, wisdom, Earth (planet), Virgo (light blue), Pisces (pale blue) and Aquarius (dark blue) (star sign), strength, steadfastness, light, friendliness, July (sky blue), February (deep blue), peace, mourning (Iran), truthfulness, love. In many diverse cultures blue is significant in religious beliefs, believed to keep the bad spirits away. |
| Green | Nature, bad spirits, spring, fertility, youth, environment, wealth, money (US), good luck, vigor, generosity, go, grass, aggression, inexperience, envy, misfortune, coldness, jealousy, disgrace (China), illness, greed, corruption (North Africa), life eternal, air, earth (classical element), sincerity, hope, Cancer (bright green, star sign), renewal, natural abundance, growth, health, August, balance, harmony, stability, Islam. During the Middle Ages, both green and yellow were used to symbolize the devil. Green is believed to be the luckiest of colors in some western countries including, Britain, Ireland (where it is also the national color) and the U.S. |
| Yellow | Sunlight, joy, happiness, earth, optimism, intelligence, idealism, wealth (gold), summer, hope, air, liberalism, cowardice, illness (quarantine), hazards, dishonesty, avarice, weakness, greed, femininity, gladness, sociability, summer, friendship, Taurus, Leo (golden yellow, star signs), April, September, deceit, hazard signs, death (Middle Ages), mourning (Egypt), courage (Japan). Yellow ribbons were worn during times of warfare as a sign of hope as women waited from their men to return. During the Middle Ages, both green and yellow were used to symbolize the devil. |
| Purple | Envy, Sensuality, spirituality, creativity, wealth, royalty, nobility, ceremony, mystery, wisdom, enlightenment, arrogance, flamboyance, gaudiness, mourning, profanity, exaggeration, confusion, homosexuality, pride, Libra (violet, star sign), May, November, riches, romanticism (light purple), delicacy (light purple). Purple is the color of mourning for widows in Thailand, favorite color of Egypt's Cleopatra, and the purple heart - given to soldiers who have been wounded during warfare. |
| Orange | Hinduism, Buddhism, energy, balance, heat, fire, enthusiasm, flamboyance, playfulness, aggression, arrogance, gaudiness, overemotion, warning, danger, enthusiasm, autumn, desire, Sagittarius (star sign), September. Orange has less intensity or aggression than red and is calmed by the cheerfulness of yellow. |
| Brown | Calm, depth, natural organisms, nature, richness, rusticism, stability, tradition, anachronism, boorishness, dirt, dullness, filth, heaviness, poverty, roughness, earth (classical element), October, Capricorn, Scorpio (reddish brown, star signs), down-to-earth. Brown can stimulate the appetite, wholesomeness, steadfastness, simplicity, and dependability. |
| Pink | Spring, gratitude, appreciation, admiration, sympathy, femininity, health, love, June, marriage, homosexuality, bisexuality (both in the form of a pink triangle). |

Color science can be complex but because it is visual tool it benefits from the adage that "a picture is worth a thousand words". Color can be used to quickly differentiate one set of items from another. For instance, sports teams wear uniforms of differing colors to make differential recognition immediate. Complex filing systems use colors to more readily identify the standard alphabetic separations. Rather than rely on words or physical descriptions for wiring diagrams, home entertainment and computer network systems routinely utilize color-coding schemes to facilitate and simplify communication of wiring arrangements.

Relevant references relating to standards and guidelines:

Polyurethane Foam Association—Joint Industry Foam Standards and Guidelines—Section 1.0: Density Standards and Guidelines, published July 1994.

Polyurethane Foam Association—Joint Industry Foam Standards and Guidelines—Section 2.0: Tensile Strength, Tear Strength, and Elongation Standards and Guidelines, published July 1994.

Polyurethane Foam Association—Joint Industry Foam Standards and Guidelines—Section 4.0: Indentation Force Deflection (IFD) Standards and Guidelines, published July 1994.

Polyurethane Foam Association—Joint Industry Foam Standards and Guidelines—Section 9.0: Flex Fatigue or In-Use Softening Standards and Guidelines, published July 1994.

The Color Answer Book, Leatrice Eisemen. Copyright 2003

SUMMARY OF THE INVENTION

It is an objective of the invention to effectively communicate the technical performance parameters of resilient filling materials used in production of home furnishing articles, such as mattresses, mattress foundations, upholstered furniture articles and other similar articles to consumers by use of color schemes that reduce the technical data to rudimentary color schemes and thus serve as a simplified method of communicating the concept of comfort to potential purchasers of such articles. It is another objective of the invention to augment the effectiveness of the communication by use of labeling comprising of words, symbols, hieroglyphs or other symbols and written methods.

The selection of the colors and labeling schemes may be further enhanced to serve to create or evoke positive, emotional triggers in the minds of end consumers for such home furnishing articles.

In one embodiment of the present invention a sequence or sequencing of colors is used to indicate or to communicate to end-users how to place the internal layers or components of a mattress in order to achieve a desired firmness of the sleep surface. For instance, colors or hues ranging from dark to light would correlate to indentation force deflection (IFD) measurements ranging from high to low. Since high IFD foams are more "firm" than low IFD foams, instructing a consumer to sequence the internal layers or components of a mattress so that the dark colors were on top of the lighter ones would be more effective than attempting to have them understand the complex calculations underlying the IFD measurements. Selection of particular hues functions to indicate or guide a consumer user how to achieve optimal sequencing or alternate sequencing of layers of filling materials to provide a desired comfort result; overall, the colorization, including hues functions as a visual equivalent indicator or correlation to comfort based upon user preferences.

Additionally, within each IFD measurement there may be varying degrees of density—these differentials might be communicated through use of varying tones, shades or values of a specific color or hue acting as subsets essentially of the chosen IFD.

The selection of colors or hues and their associated tonal, shade and value variations is not contemplated by the present invention to potentially limit the selection based on the hues underlying ability to evoke emotional responses from end consumers.

The selection of particular hues and subsequent use of associated tonal, shade or value variations to those hues is not intended to limiting on the scope of the present invention.

The use of symbols or words to complement the color selection is fully contemplated by the present invention as the reality is that a small percentage of consumers is color-blind and may not be able to differentiate from the proposed color based communication scheme.

BRIEF DESCRIPTION OF THE DRAWINGS

FIG. 4 is a one dimensional matrix depicting the use of a specific hue and tints of that hue to communicate variation of the density of flexible polyurethane foam.

FIG. 5. is a two dimensional matrix depicting the use of a range of hues and tints of the hues to communicate a two variable performance attribute measurement that relates the density of the foam to the firmness as measured by the IFD (indentation force deflection) measurement.

FIG. 6. is a three dimensional matrix depicting the use of a range of hues, tints and shades two communicate a tri-variable performance attribute measurement system that relates the density of the foam to the firmness of the foam as measured by the IFD to the measurement of resilience or "springiness" of the foam as measured by ASTM D3574.

DETAILED DESCRIPTION OF THE DRAWINGS

Figure 1:
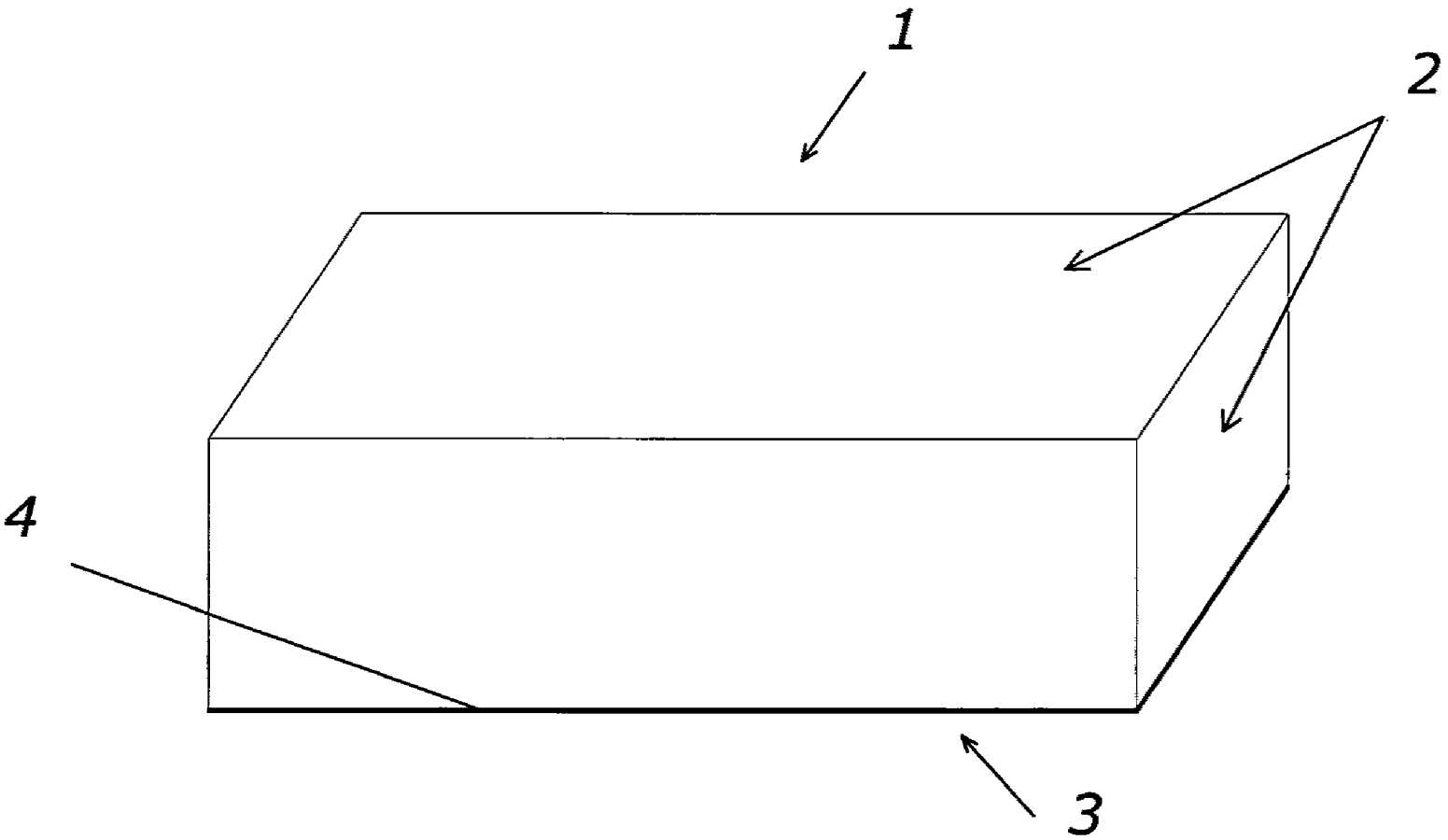
FIG. 1 is a picture of a bed mattress, in accordance with an embodiment of the present invention.

One facet of the method offered by the present invention relates to its use in simplifying the communication of complex performance attributes of mattresses and mattress sets to consumers. In the context of the present invention, terms relating to mattresses are defined in conformity with terms as defined by 16 C.F.R. 1632, and as follows:

"(a) Mattress means a ticking filled with a resilient material used alone or in combination with other products intended or promoted for sleeping upon.

(1) This definition includes, but is not limited to, adult mattresses, youth mattresses, crib mattresses including portable crib mattresses, bunk bed mattresses, futons, water beds and air mattresses which contain upholstery material between the ticking and the mattress core, and any detachable mattresses used in any item of upholstered furniture such as convertible sofa bed mattresses, corner group mattresses, day bed mattresses, roll-a-way bed mattresses, high risers, and trundle bed mattresses. See Sec. 1632.8 Glossary of terms, for definitions of these items.

(2) This definition excludes sleeping bags, pillows, mattress foundations, liquid and gaseous filled tickings such as water beds and air mattresses which do not contain upholstery material between the ticking and the mattress core, upholstered furniture which does not contain a detachable mattress such as chaise lounges, drop-arm love seats, press-back lounges, push-back sofas, sleep lounges, sofa beds (including jackknife sofa beds), sofa lounges (including glide-outs), studio couches and studio divans (including twin studio divans and studio beds), and juvenile product pads such as car bed pads, carriage pads, basket pads, infant carrier and lounge pads, dressing table pads, stroller pads, crib bumpers, and playpen pads. See Sec. 1632.8 Glossary of terms, for definitions of these items.

(b) Mattress Pad means a thin, flat mat or cushion, and/or ticking filled with resilient material for use on top of a mattress. This definition includes, but is not limited to, absorbent mattress pads, flat decubitus pads, and convoluted foam pads which are totally enclosed in ticking. This definition excludes convoluted foam pads which are not totally encased in ticking.

(c) Ticking means the outermost layer of fabric or related material that encloses the core and upholstery materials of a mattress or mattress pad. A mattress ticking may consist of several layers of fabric or related materials quilted together.

(d) Core means the main support system that may be present in a mattress, such as springs, foam, hair block, water bladder, air bladder, or resilient filling.

(e) Upholstery material means all material, either loose or attached, between the mattress or mattress pad ticking and the core of a mattress, if a core is present.

(f) Tape edge (edge) means the seam or border edge of a mattress or mattress pad.

(g) Quilted means stitched with thread or by fusion through the ticking and one or more layers of upholstery material.

(h) Tufted means buttoned or laced through the ticking and upholstery material and/or core, or having the ticking and upholstery material and/or core drawn together at intervals by any other method which produces a series of depressions on the surface." (16CFR1632.2)

"(r) Mattress foundation consists of any surface such as foam, box springs or other, upon which a mattress is placed to lend it support for use in sleeping upon." (16CFR1632.8)

Additionally, in the context of the present invention, these terms are further defined in conformity with terms as defined in the NPR on Mattress Flammability of 16 CFR 1633 as published by the CPSC in the Federal Register on Jan. 13, 2005.

A second element of the present invention relates to its use in simplifying the communication of complex performance attributes of articles of upholstered furniture. In the context of the present invention, terms relating to upholstered furniture are defined in conformity with terms as defined by the draft language of 16 C.F.R. 1634, as published by the CPSC in May 2005, and incorporated in their entirety herein by reference.

A third element of the present invention relates to its use in simplifying the communication of complex performance attributes found in other articles filled with resilient cushioning materials. In the context of the present invention, terms relating to filled articles and bedding are defined as follows in conformity with the terms defined by the California BHFTI draft of Technical Bulletin #604 published Oct. 1, 2004, and the ANPR for 16 CFR 1634 Standard To Address Open Flame Ignition of Bedclothes published by the CPSC in the Federal Register on Jan. 13, 2005, pages 2514 through 2517, and incorporated in their entirety herein by reference.

The technical terminology used to identify colors may be defined as follows:

a. Hue—a synonym for the name of the color that reflects the dominant wavelength, e.g., red, blue, yellow, etc.

b. Saturation or chroma—this describes the intensity of a color, in other words, how much gray it contains. The greater the saturation, the more the color approached the true color of the spectrum.

c. Value—this refers to the lightness or darkness of a color. Colors with close values may be perceived as calm, while those of disparate values are less calming.

d. Shade—this is the mixture of a fully saturated hue with black.

e. Tone—a mixture of a saturated color or hue with gray f. Tint—a mixture of a saturated color or hue with white.

g. Primary colors—Yellow, red and blue.

h. Secondary colors—Green, orange and violet.

i. Color temperature—a characteristic of visible light that has important applications in photography, videography, publishing and other fields. The color temperature of a light source is determined by comparing its hue with a theoretical, heated black-body radiator. The Kelvin temperature at which the heated black-body radiator matches the hue of the light source is that source's color temperature, and it is directly related to Planck's law. Color temperature perception—reds being "warm" and blues being "cold" can play a significant role in the emotional perception of colors.

Specific design parameters of the mattress, mattress foundation, upholstered furniture article or other article filled with resilient cushioning materials are not intended to limit the scope of the present invention.

EXAMPLES

Example 1

Twin Sized Mattress

FIG. 1 shows a crafted single, twin-sized mattress, fully measuring 75" long×39" wide×12" thick, in accordance with an embodiment of the present invention. The mattress has a removable cover 1, formed from a knitted mattress ticking material 2 that covers the sides and top panel of the mattress and a non-woven mattress filler cloth/nonskid fabric 3 that covers the bottom panel of the mattress and made into a removable cover with zipper 4 the serve to fully encase the foam containment unit when filled with the six layers and wrapped with the fabric "girdle". The removable cover can be opened and closed with a zipper 4 that either partially or fully traverses the circumference of the mattress and allows easy access to the multiple units of foam in the foam containment unit.

Figure 2:
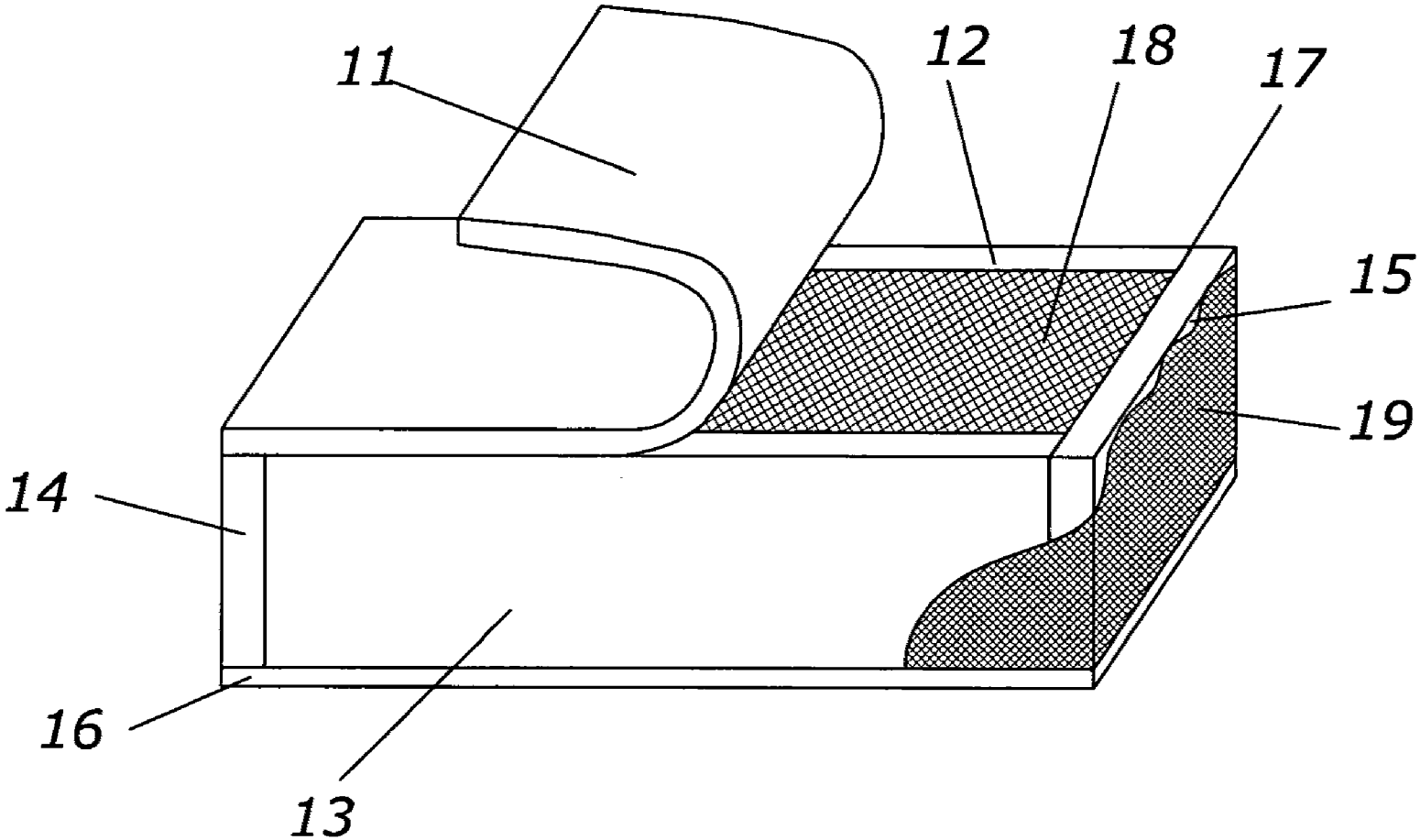
FIG. 2 is a picture of a bed mattress depicting a layer of cushioning material covered with a colored fabric sleeve and a foam containment unit, in accordance with an embodiment of the present invention.

FIG. 2 depicts an internal view of the mattress from FIG. 1, from which the cover has been removed. The foam containment unit 17 was fashioned in the following manner. Two sheets of flexible polyurethane foam (FPF) material 11 and 16 measuring 75" long×39" wide×1" thick were prepared. Additionally, two blocks ("side") of FPF material 12 and 13 measuring 75" long×3" wide×10" tall and two blocks ("head/foot") of FPF material 14 and 15 measuring 3" long×33" wide×10" tall were made.

One of the two sheets of FPF measuring 75"×39"×1" was placed on a flat surface. Standard adhesive glue was completely applied to a 3" border at the outermost edge of the sheet. Glue was then applied to only one of the two 3"×75" sides of each "side" block and to only one of the two 3"×33" sides of each "head/foot" block. Additionally glue was applied to both of the 3"×10" sides of each "head/foot" block.

The glued 3" sides of the two 75" long blocks were then placed on the glued 3" border of the 1" thick sheet along each of the sides measuring 75". The glued 3" sides of the two 33" wide blocks were then placed on the glued 3" border of the 1" thick sheet along each of the sides measuring 39", however because of the previous placement of the two 75" long "side" blocks the opening for the "head/foot" blocks is 33". After placement on the glued 3" border of the 1" sheet, the glued 3"×10" sides of the "head/foot" blocks were pressed securely against the "side" blocks to join the four blocks together along the full 10" height of the blocks and to fashion a corner and to close the perimeter created by the "side" and "head/foot" blocks.

Glue was then applied along the remaining exposed 3"×75" portion of only one of the two "side" blocks and the remaining 75"×39"×1" sheet was adhered to this block in such a way as to traverse the opening created and to form a rectangular box with retractable lid 11 as the sheet is not adhered to the remaining top edges of the two "head/foot" blocks and the unglued "side" block".

A fabric "girdle" 19 was fashioned from a stiff, flame retardant fabric material that measured 12" wide and approximately 228" in length. The material was joined at the two 12" ends with thread and then placed around the circumference of the perimeter of the foam containment unit. The purpose of this girdle was to provide lateral, support to the foam walls of the containment unit and to mitigate outward deflection of the unit when a sleeping load was applied to the mattress.

Figure 3:
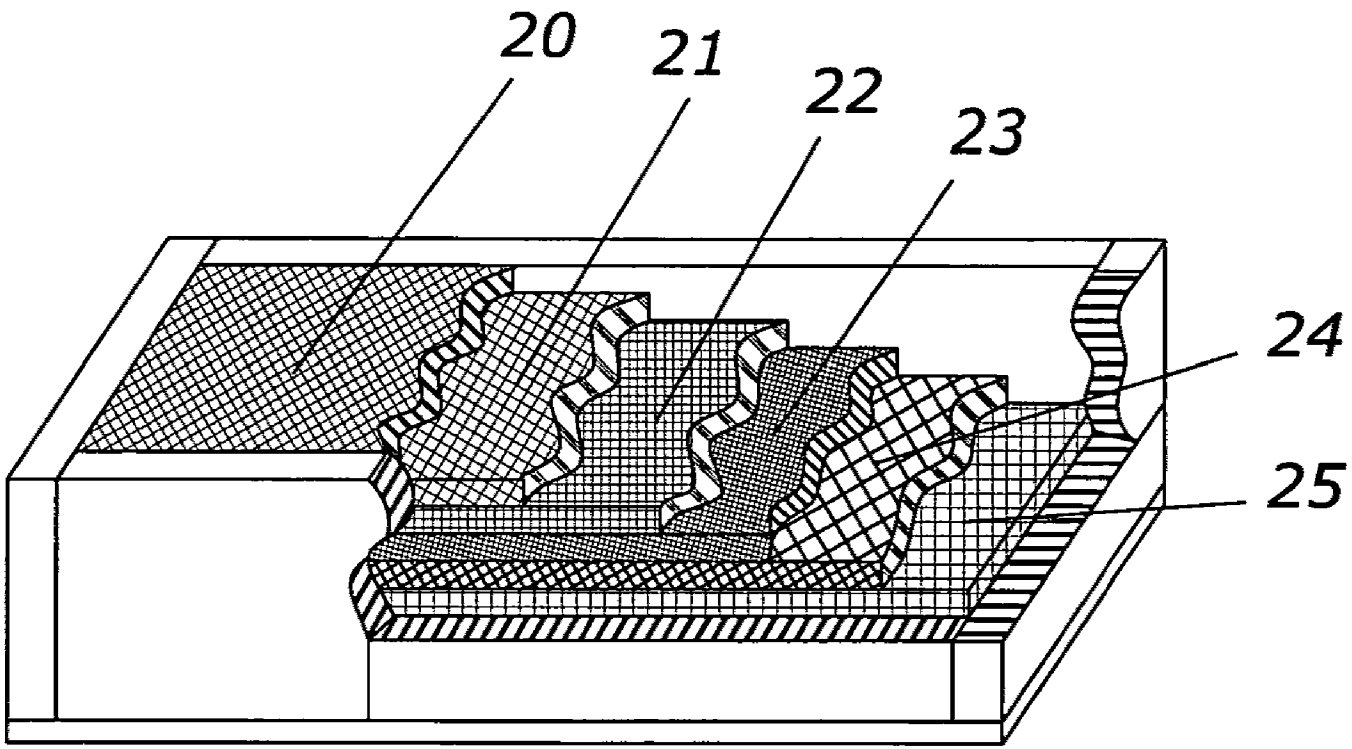
FIG. 3 is a picture of a bed mattress depicting multiple layers of cushioning material covered with fabric sleeves of different colors, in accordance with an embodiment of the present invention.

FIG. 3 depicts multiple layers 20, 21, 22, 23, 24, and 25 of cushioning material covered with fabric sleeves of different colors, in accordance with an embodiment of the present invention. Six layers of resilient cushioning material were prepared—each measuring approximately 75"×39" and being between one to two inches thick. The materials selected represented a variety of differing foam compositions—3 sheets were formed of standard polyurethane foam with 3 different measures of density, one sheet was formed of visco-elastic memory foam, one sheet was formed of latex foam and a one sheet was formed of polyester fiber batting. The foam compositions of the layers of cushioning material are meant as an example. It will be apparent to one skilled in the art that other foam compositions can be used and in varying numbers without deviating from the scope of the invention.

Each layer of resilient cushioning material was encased in a knitted fabric sleeve that fully enclosed the material and was sewn closed at each end with standard thread. The color of the fabric sleeve used for each layer of cushioning material was different. The color was varied in order to effectively communicate to consumers the variation in the technical performance attributes of the different layers. As an alternative to encasing the resilient cushioning material in knitted fabric sleeves of different color schemes, the color schemes can be directly applied to the cushioning material by printing, painting, dying, stamping or another method of applying color to the cushioning material.

In addition to coloring the fabric sleeve or the cushioning material itself to effectively communicate the technical properties of the cushioning material, various other schemes can also be used. These schemes include various labeling schemes comprising a combination of colors and labels applied to the fabric sleeves and/or the cushioning material. The labels can include text, symbols, hieroglyphs and a combination thereof in varying shades, hues, tints and colors.

The retractable lid was opened on the foam containment unit and the six layers were placed inside the unit—one on top of the other. The lid was then returned to the position where it covered the opening in the unit and thus covered the layers of resilient cushioning material and prevented the colors of the different layers from being visible to the consumer during normal use of the article.

The removable cover as previously described was installed on the foam containment unit to create a finished mattress.

In addition to the construction of the mattress, the use of colors to identify various technical aspects of the cushioning materials can be useful during purchasing of said mattress by a consumer. The consumer can purchase the said mattress at a retail store, a warehouse, online or any other means of buying and selling items known in the art. The consumer identifies colors/hues/tints/symbols based on his or her desired attributes from the mattress. The colors/hues/tints/symbols are then assembled in a sequence that is either predetermined or determined by the consumer based on the desired properties from the mattress. The merchant then assembles the cushioning material based on the consumer selection and the final product is delivered to the consumer. In another embodiment, the multiple layers of cushioning material are sold individually to the consumer and the consumer assembles the mattress based on his or her preference or a suggested sequence from the manufacturer or retailer.

FIG. 4 is a one dimensional matrix depicting the use of a specific hue and tints of that hue to communicate variation of the density of flexible polyurethane foam. In this case, the color ("hue") blue is selected to identify the foam and progressive tints of blue, achieved by adding increasing amounts of white to the hue, are used to signify a decrease in the density for a range from 6.0 pounds per cubic foot (pcf) to 1.0 pounds pcf. In this instance, the simplistic correlation is created between the "darkness" of the color and the density of the foam, wherein the darker color/hue communicates a foam with a lower concentration of air (as measured by the density amount) and as air is added (thereby decreasing the density) the color lightens (as white is added to the hue).

FIG. 5. is a two dimensional matrix depicting the use of a range of hues and tints of the hues to communicate a two variable performance attribute measurement that relates the density of the foam to the firmness as measured by the IFD (indentation force deflection) measurement. Again, as in FIG. 4, increasing the white level added to the hue can serve to depict increasing air content in the foam—thereby lowering the density measurement, and in this case, the range of hues communicates softer foams (those with lower IFD values) as being associated with the cooler colors (violet end of spectrum) and harder foams (those with higher IFD values) as being associated with warmer colors (red end of spectrum).

FIG. 6. is a three dimensional matrix depicting the use of a range of hues, tints and shades two communicate a tri-variable performance attribute measurement system that relates the density of the foam to the firmness of the foam as measured by the IFD to the measurement of resilience or "springiness" of the foam as measured by ASTM D3574.

The specific values and measurements chosen for FIGS. 4, 5, and 6, as well as the color correlations employed are not intended to be exhaustive or limiting of the variations that may be employed to use color schemes such as those disclosed herein to communicate performance attributes of composite furnishing articles. The mere fact that different colors may convey different meanings based on cultural differences of the audiences to whom the embodiments of the present invention may be targeted, requires that the practice of this approach be provided the flexibility to adapt the scheme based on cultural or geographic differences.

The scheme employed to use color to describe various performance attributes may be coordinated in such a manner as to signal to the consumer an optimal or recommended sequencing of materials to achieve a desired comfort outcome or an arrangement of materials so as to best permit the furnishing article to be fitted for a body type, weight or morphology.

In practical terms the limitations of a given manufacturing approach may not be able to effectively reproduce the broadest ranges of subtle color variations of tint or shade at levels suitably perceptible to the naked eye.

The above example serves to elucidate an embodiment of the present invention. It will be evident to one skilled in the art that the scope of the invention is not limited to the above stated example, but can extended to include a variety of home furnishings in a variety of dimensions including a number of permutations and combinations of the cushioning materials having different coloring and labeling schemes applied in multiple ways. Additionally, the dimensions, and number of constituting materials do not serve to limit the invention in any way, as will be apparent to one skilled in the art.

What is claimed is:

1. A method of using colors or color schemes to simplify the communication to end-consumers of the degree of comfort as quantified by the measurement of material density, degree of indentation force deflection (IFD), tensile strength, denier, cut length or basis weight, or the composition of resilient filling materials that are engineered into mattresses prior to the use by the end-consumer so that adjustment by the end-consumer is facilitated, the method comprising the steps of: providing colors or a color scheme wherein each element of the colors or color scheme is associated with a measured degree of comfort or composition of the resilient filling material; and associating the colors or color scheme and corresponding measured degrees of comfort, including material density, IFD and composition density, with mattresses, wherein the colors or color scheme and corresponding measured degrees of comfort or composition of the resilient filling materials indicate to the end-consumer the level of comfort preferred, without adjustment by the end-consumer and wherein the mattresses comprise a mattress ticking enclosing a mattress core support system, including springs, foam, hair block, bladder or resilient filling, and comfort material between the mattress ticking and the core support system, the core support system wrapped and supported laterally by a fabric girdle to mitigate outward deflection under load, the girdle comprising a stiff, flame retardant fabric material about 12" wide and about 228" in length joined at two 12" ends with thread and positioned around the circumference of the perimeter of the foam containment unit; all integrally combined for supporting a person lying thereupon, the mattresses are at least about 39 inches wide and at least about 75 inches long, and wherein the mattress expressly excludes upholstered furniture cushions.

2. A method according to claim 1, wherein said mattresses are comprised of mattresses, mattress foundations and articles filled with cushioning materials intended or promoted for sleeping upon.

3. A method according to claim 1, wherein said colors or color schemes are located inside said mattresses and are not designed to be externally visible during normal use of the product.

4. A method according to claim 1, wherein said colors or color schemes are integrated into textile materials that at least partially enclose at least one internal element of said mattress.

5. A method according to claim 1, wherein said colors or color schemes are directly applied to at least one internal element of said mattress by printing, painting, dying, or stamping.

6. A method according to claim 1, wherein said colors or color schemes are selected from the group consisting of tints, hues, shades, families of colors, and combinations thereof that communicate or evoke emotional triggers to the intended end-consumer of said mattress.

7. A method according to claim 1, wherein said cushioning materials may be resilient or non-resilient and are selected from the group consisting of at least one of foam, fiber, springs, hair block, batting, wadding, bladders filled with either gas or liquid, and combinations thereof.

8. A method of using integrated colors or color and labeling schemes to simplify the communication to consumers of the degree of comfort as quantified by the indentation force deflection (IFD) measurement engineered into mattresses prior to the use by the end-consumer so that adjustment by the end-consumer is not required, the method comprising the steps of: providing an integrated color and labeling scheme wherein the integrated color and labeling scheme communicates to the end-consumer choices relating to corresponding IFD measurement; and associating the integrated color and labeling scheme and corresponding IFD measurement with mattresses, wherein the integrated color and labeling scheme and corresponding IFD measurement indicate to the end-consumer the level of IFD preferred, without adjustment by the end-consumer, and wherein the mattresses comprise a mattress ticking enclosing a mattress core support system, including springs, foam, hair block, bladder or resilient filling, and comfort material between the mattress ticking and the core support system, the core support system wrapped and supported laterally by a fabric girdle to mitigate outward deflection under load, the girdle comprising a stiff, flame retardant fabric material about 12" wide and about 228" in length joined at two 12" ends with thread and positioned around the circumference of the perimeter of the foam containment unit; all integrally combined for supporting a person lying thereupon, the mattresses are at least about 39 inches wide and at least about 75 inches long, and wherein the mattress expressly excludes upholstered furniture cushions.

9. A method according to claim 8, wherein said labeling schemes use letters to form words that communicate or evoke emotional triggers to the intended end-consumer of said home furnishing article.

10. A method according to claim 8, wherein said labeling schemes use symbols or hieroglyphs to communicate or evoke emotional triggers to the intended end-consumer of said mattress.

11. A method of using color schemes to create or evoke positive emotional reactions and simplify the communication to consumers of complex, technical performance attributes that describe the degree of comfort and are engineered into mattresses, the methods steps comprising: providing a mattress having a mattress ticking enclosing a mattress core support system, including springs, foam, hair block, bladder or resilient filling, and comfort material between the mattress ticking and the core support system, the core support system wrapped and supported laterally by a fabric girdle to mitigate outward deflection under load, the girdle comprising a stiff, flame retardant fabric material about 12" wide and about 228" in length joined at two 12" ends with thread and positioned around the circumference of the perimeter of the foam containment unit; all integrally combined for supporting a person lying thereupon, the mattresses are at least about 39 inches wide and at least about 75 inches long, and wherein the mattress expressly excludes upholstered furniture cushions; and coloring the mattress ticking, foam, hair block, bladder or resilient filling and comfort material to correspond to their indentation force deflection measurement according to a color scheme.

12. A method according to claim 11, wherein said mattresses are comprised of mattress foundations, and other articles used for supporting a person or animal that are filled with cushioning materials.

13. A method according to claim 11, wherein said color schemes are located inside said mattresses and are not designed to be externally visible during normal use of the product.

14. A method according to claim 11, wherein said color schemes are integrated into textile materials that at least partially enclose at least one internal element of said mattresses.

15. A method according to claim 11, wherein said color schemes are directly applied to at least one internal element of said mattresses by printing, painting, dying, or stamping.

16. A method according to claim 11, wherein said color schemes are selected from the group consisting of tints, hues, shades, families of colors, and combinations thereof that communicate or evoke emotional triggers to the intended end-consumer of said mattresses.

17. A method according to claim 11, wherein said cushioning materials may be resilient or non-resilient and selected from the group consisting of at least one of foam, fiber, springs, hair block, batting, wadding, bladders filled with either gas or liquid, and combinations thereof.

18. A method of using color and labeling schemes to create or evoke positive emotional reactions and simplify the communication to consumers of complex, technical performance attributes that describe the degree of comfort and are engineered into mattresses prior to the use by the end-consumer so that adjustment by the end-consumer is not required, the method comprising the steps of: providing a color and labeling scheme wherein the color and labeling scheme communicates to the end-consumer choices relating to corresponding indentation force deflection (IFD) measurement; and associating the color and labeling scheme and corresponding IFD measurements with mattresses, wherein the colors or color and labeling scheme and corresponding IFD measurements indicate to the end-consumer the level of IFD preferred, without adjustment by the end-consumer and wherein the mattresses comprise a mattress ticking enclosing a mattress core support system, including springs, foam, hair block, bladder or resilient filling, and comfort material between the mattress ticking and the core support system, the core support system wrapped and supported laterally by a fabric girdle to mitigate outward deflection under load, the girdle comprising a stiff, flame retardant fabric material that measured 12" wide and approximately 228" in length joined at the two 12" ends with thread and then placed around the circumference of the perimeter of the foam containment unit; all integrally combined for supporting a person lying thereupon, the mattresses are at least about 39 inches wide and at least about 75 inches long, and wherein the mattress expressly excludes upholstered furniture cushions.

19. A method according to claim 18, wherein said labeling schemes use letters to form words that communicate or evoke emotional triggers to the intended end-consumer of said mattress.

20. A method according to claim 18, wherein said labeling schemes use symbols or hieroglyphs to communicate or evoke emotional triggers to the intended end-consumer of said mattress.

21. A mattress comprised of colors or a color scheme used to communicate to consumers the measurement of indentation force deflection (IFD) engineered into the article wherein the mattresses comprise a mattress ticking enclosing a mattress core support system, including springs, foam, hair block, bladder or resilient filling, and comfort material between the mattress ticking and the core support system, the core support system wrapped and supported laterally by a fabric girdle to mitigate outward deflection under load, the girdle comprising a stiff, flame retardant fabric material about 12" wide and about 228" in length joined at two 12" ends with thread and then positioned around the circumference of the perimeter of the foam containment unit; all integrally combined for supporting a person lying thereupon, the mattresses are at least about 39 inches wide and at least about 75 inches long, wherein the color of the mattress ticking corresponds to the IFD of the mattress according to the color scheme; and wherein the mattress expressly excludes upholstered furniture cushions.

22. A mattress according to claim 21, which includes a mattress foundation.

23. A mattress according to claim 21, which is filled with cushioning materials wherein said cushioning materials may be resilient or non-resilient and are selected from the group consisting of at least one of foam, fiber, springs, hair block, batting, wadding, bladders filled with either gas or liquid, and combinations thereof.

24. A mattress comprised of a color and labeling scheme used to communicate to consumers the degree of comfort as quantified by the measurement of indentation force deflection (IFD) engineered into the article, wherein the color and labeling scheme correspond to levels of IFD engineered into the article without requiring any modification by the consumer after use, wherein the mattress comprises a mattress ticking enclosing a mattress core support system, including springs, foam, hair block, bladder or resilient filling, and comfort material between the mattress ticking and the core support system, the core support system wrapped and supported laterally by a fabric girdle to mitigate outward deflection under load, the girdle comprising a stiff, flame retardant fabric material about 12" wide and about 228" in length joined at two 12" ends with thread and then positioned around the circumference of the perimeter of the foam containment unit; all integrally combined for supporting a person lying thereupon, the mattresses are at least about 39 inches wide and at least about 75 inches long, and wherein the mattress expressly excludes upholstered furniture cushions.

25. A mattress according to claim 24, which includes a mattress foundation.

26. A mattress according to claim 24, which is filled with cushioning materials wherein said cushioning materials may be resilient or non-resilient and are selected from the group consisting of at least one of foam, fiber, springs, hair block, batting, wadding, bladders filled with either gas or liquid, and combinations thereof.

27. A method according to claim 1, wherein the technical performance attributes that describe the degree of comfort comprise firmness, density and resilience.

* * * * *